US006633284B1

(12) United States Patent
Hanari

(10) Patent No.: US 6,633,284 B1
(45) Date of Patent: Oct. 14, 2003

(54) FLAT DISPLAY DEVICE

(75) Inventor: Jun Hanari, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 156 days.

(21) Appl. No.: 09/821,454

(22) PCT Filed: Aug. 3, 2000

(86) PCT No.: PCT/JP00/05215

§ 371 (c)(1),
(2), (4) Date: May 31, 2001

(87) PCT Pub. No.: WO01/11598

PCT Pub. Date: Feb. 15, 2001

(30) Foreign Application Priority Data

Aug. 5, 1999 (JP) ..... 11-222770

(51) Int. Cl.[7] ..... G09G 3/36
(52) U.S. Cl. ..... 345/204; 345/96
(58) Field of Search ..... 345/204, 96, 211, 345/213, 205, 206, 87, 92, 212, 98, 99, 100; 377/69; 327/144; 361/760, 802

(56) References Cited

U.S. PATENT DOCUMENTS

| | | | | |
|---|---|---|---|---|
| 6,201,523 | B1 * | 3/2001 | Akiyama et al. | 345/96 |
| 6,268,841 | B1 * | 7/2001 | Cairns et al. | 345/98 |
| 6,388,651 | B1 * | 5/2002 | Kinoshita et al. | 345/98 |
| 6,437,775 | B1 * | 8/2002 | Hanari | 345/204 |

FOREIGN PATENT DOCUMENTS

| | | |
|---|---|---|
| JP | 1-130131 | 5/1989 |
| JP | 1-174186 | 7/1989 |
| JP | 3-51887 | 3/1991 |
| JP | 10-274762 | 10/1998 |
| JP | 11-119736 | 4/1999 |

* cited by examiner

*Primary Examiner*—Vijay Shankar
*Assistant Examiner*—Nitin Patel
(74) *Attorney, Agent, or Firm*—Oblon, Spivak, McClelland, Maier & Neustadt, P.C.

(57) ABSTRACT

A flat panel display divides a screen into blocks each provided with data-line drivers. Each of the data-line drivers is provided with D/A converters. Data lines (Dj, Dj+1, Dj+2, Dj+3, . . . ) connected to the D/A converters (11*a*, 12*a*, 11*b*, 12*b*) are alternately arranged at intervals of a predetermined number.

10 Claims, 11 Drawing Sheets

FIG.11

L1 (24 LINES)

| POL=0 | POL=1 |
|---|---|
| L1P1 | L1N1 |
| L1N1 | L1P1 |
| L1P2 | L1N2 |
| L1N2 | L1P2 |
| L1P3 | L1N3 |
| L1N3 | L1P3 |
| L1P4 | L1N4 |
| L1N4 | L1P4 |
| L1P5 | L1N5 |
| L1N5 | L1P5 |
| L1P6 | L1N6 |
| L1N6 | L1P6 |
| L1P7 | L1N7 |
| L1N7 | L1P7 |
| L1P8 | L1N8 |
| L1N8 | L1P8 |
| L1P9 | L1N9 |
| L1N9 | L1P9 |
| L1P10 | L1N10 |
| L1N10 | L1P10 |
| L1P11 | L1N11 |
| L1N11 | L1P11 |
| L1P12 | L1N12 |
| L1N12 | L1P12 |

| BLOCK 1 | 2 | 3 | 4 | 0 | 31 | 32 |
|---|---|---|---|---|---|---|
| R 249 | R 241 | R 233 | R 225 | R 17 | R 9 | R 1 |
| G 249 | G 241 | G 233 | G 225 | G 17 | G 9 | G 1 |
| B 249 | B 241 | B 233 | B 225 | B 17 | B 9 | B 1 |
| R 250 | R 242 | R 234 | R 226 | R 18 | R 10 | R 2 |
| G 250 | G 242 | G 234 | G 226 | G 18 | G 10 | G 2 |
| B 250 | B 242 | B 234 | B 226 | B 18 | B 10 | B 2 |
| R 251 | R 243 | R 235 | R 227 | R 19 | R 11 | R 3 |
| G 251 | G 243 | G 235 | G 227 | G 19 | G 11 | G 3 |
| B 251 | B 243 | B 235 | B 227 | B 19 | B 11 | B 3 |
| R 252 | R 244 | R 236 | R 228 | R 20 | R 12 | R 4 |
| G 252 | G 244 | G 236 | G 228 | G 20 | G 12 | G 4 |
| B 252 | B 244 | B 236 | B 228 | B 20 | B 12 | B 4 |
| R 253 | R 245 | R 237 | R 229 | R 21 | R 13 | R 5 |
| G 253 | G 245 | G 237 | G 229 | G 21 | G 13 | G 5 |
| B 253 | B 245 | B 237 | B 229 | B 21 | B 13 | B 5 |
| R 254 | R 246 | R 238 | R 230 | R 22 | R 14 | R 6 |
| G 254 | G 246 | G 238 | G 230 | G 22 | G 14 | G 6 |
| B 254 | B 246 | B 238 | B 230 | B 22 | B 14 | B 6 |
| R 255 | R 247 | R 239 | R 231 | R 23 | R 15 | R 7 |
| G 255 | G 247 | G 239 | G 231 | G 23 | G 15 | G 7 |
| B 255 | B 247 | B 239 | B 231 | B 23 | B 15 | B 7 |
| R 256 | R 248 | R 240 | R 232 | R 24 | R 16 | R 8 |
| G 256 | G 248 | G 240 | G 232 | G 24 | G 16 | G 8 |
| B 256 | B 248 | B 240 | B 232 | B 24 | B 16 | B 8 |

L2 (24 LINES)

| POL=0 | POL=1 |
|---|---|
| L1P1 | L1N1 |
| L1N1 | L1P1 |
| L1P2 | L1N2 |
| L1N2 | L1P2 |
| L1P3 | L1N3 |
| ⋮ | ⋮ |

| BLOCK 1 | 2 | 3 | 4 | | 31 | 32 |
|---|---|---|---|---|---|---|
| R 257 | R 265 | R 273 | R 281 | R | R 497 | R 505 |
| G 257 | G 265 | G 273 | G 281 | G | G 497 | G 506 |
| B 257 | B 265 | B 273 | B 281 | B | B 497 | B 506 |
| R 258 | R 266 | R 274 | R 282 | R 2 | R 497 | R 507 |
| G 258 | G 266 | G 274 | G 282 | G 2 | G 497 | G 507 |
| ⋮ | ⋮ | ⋮ | ⋮ | ⋮ | ⋮ | ⋮ |

R1 (24 LINES)

| POL=0 | POL=1 |
|---|---|
| R1P1 | R1N1 |
| R1N1 | R1P1 |
| R1P2 | R1N2 |
| R1N2 | R1P2 |
| R1P3 | R1N3 |
| ⋮ | ⋮ |

| BLOCK 1 | 2 | 3 | 4 | 5 | | 32 |
|---|---|---|---|---|---|---|
| R 761 | R 753 | R 745 | R 737 | R 729 | 521 | R 513 |
| G 761 | G 753 | G 745 | G 737 | G 729 | 521 | G 513 |
| B 761 | B 753 | B 745 | B 737 | B 729 | 521 | B 513 |
| R 762 | R 754 | R 746 | R 738 | R 730 | 522 | R 514 |
| G 762 | G 754 | G 746 | G 738 | G 730 | 522 | G 514 |
| ⋮ | ⋮ | ⋮ | ⋮ | ⋮ | ⋮ | ⋮ |

R2 (24 LINES)

| POL=0 | POL=1 |
|---|---|
| R1P1 | R1N1 |
| R1N1 | R1P1 |
| R1P2 | R1N2 |
| R1N2 | R1P2 |
| R1P3 | R1N3 |
| ⋮ | ⋮ |

| BLOCK 1 | 2 | 3 | 4 | 5 | 31 | 32 |
|---|---|---|---|---|---|---|
| R 769 | R 777 | R 785 | R 793 | R | R 1009 | R 1017 |
| G 769 | G 777 | G 785 | G 793 | G 1 | G 1009 | G 1017 |
| B 769 | B 777 | B 785 | B 793 | B 1 | B 1009 | B 1017 |
| R 770 | R 778 | R 785 | R 794 | 2 | R 1010 | R 1018 |
| G 770 | G 778 | G 785 | G 794 | 02 | G 1010 | G 1018 |
| ⋮ | ⋮ | ⋮ | ⋮ | ⋮ | ⋮ | ⋮ |

FLAT DISPLAY DEVICE

TECHNICAL FIELD

This invention relates to flat panel displays, and more precisely, to the structures of drivers for flat panel displays such as active matrix liquid crystal displays.

BACKGROUND TECHNOLOGY

Among flat panel displays, liquid crystal displays employing liquid crystal layers as light modulation layers are light, thin, and low-power-consumption, and due to these characteristics, are used in various fields. In particular, active matrix liquid crystal displays employing a switching element for each pixel are rapidly spreading as displays for OA appliances such as personal computers.

In the present active matrix liquid crystal displays, pixel switching elements on an array substrate are usually made of thin-film transistors (TFTs) using amorphous silicon (a-Si) for active layers. Recently marketed are displays employing pixel switching elements made of TFTs that use polysilicon (p-Si) for active layers.

Compared with the a-Si TFTs, the p-Si TFTs have higher electron mobility, and therefore, can be formed in small sizes to provide an advantage of partly forming drivers in a space on a substrate. For example, an entire gate-line driver and part of a data-line driver including shift registers and analog switching elements may be formed on an array substrate, and on an external printed circuit board (PCB), D/A converters, etc., of the data-line driver and a control IC for generating various control signals may be formed.

An improvement in screen resolution requires an improvement in the operation speed and data write speed of a data-line driver. To cope with this, there is a technique to divide pixels to be driven in a horizontal scan period into several large blocks, simultaneously transmit data to the large blocks, and simultaneously process the data. In each of the large blocks, the technique divides data lines into small blocks and sequentially drives the small blocks. This technique is capable of elongating a sampling time that is based on the output of a shift register.

As an example, a screen having a matrix of 1024 pixels in a horizontal direction, i.e., XGA (1024×768) is considered. Eight pixels (each pixel consisting of three dots, i.e., R, G, and B dots) connected to 24 data lines form a small block. Such small blocks are sequentially scanned at horizontal scan intervals of 1/32, to drive 256 pixels in one horizontal scan period. The 256 pixels correspond to ¼ (a large block) of the screen. Namely, data for four parallel columns, i.e., 24×4=96 video signals must be supplied for the screen. If there is a driver IC capable of supplying 48 signals, two such driver ICs will be needed.

In this way, a screen may be divided into four large blocks, for which video data are simultaneously sampled and provided. This technique can elongate the sampling time of a shift register four times that of a single shift register that sequentially samples video data for a screen, thereby displaying better images.

If the number of pixels is increased to realize high resolution in the future, the number of data lines simultaneously connected to a screen will be increased. In this case, each large block will be driven with a larger number of driver ICs. Driver ICs involve subtle differences in the output characteristics thereof, even if they are from the same manufacturing lot, and in addition, are connected to wires of different lengths. As a result, the driver ICs show performance offsets. Due to the offsets, the boundaries of each driver IC will appear on a screen even in the same large block.

Even if adjacent driver ICs provide signal voltages of the same level, an offset between the driver ICs may cause a difference between voltages applied to liquid crystals, to cause unevenness in the contrast of a screen and make boundaries visible. This problem will also occur when driver ICs with p-Si TFTs are integrated on a substrate because driver circuits involve offsets.

An object of this invention is to provide a flat panel display capable of displaying good images with suppressed boundaries even if each large block is driven by a plurality of data-line drivers.

DISCLOSURE OF INVENTION

A flat panel display according to a first aspect of this invention includes a display panel containing an array substrate, a counter substrate facing the array substrate, and a light modulation layer interposed between the array substrate and the counter substrate. The array substrate includes a matrix of data lines and scan lines arranged on an insulating substrate, pixel switch elements arranged at the intersections of the data and scan lines, and pixel electrodes connected to the pixel switch elements. The flat panel display also includes a data-line driver arranged on the insulating substrate, for providing the data lines with corresponding analog video signals, and a scan-line driver for providing the scan lines with scan signals. The data-line driver at least includes first and second digital-to-analog converters for sequentially converting digital video signals for given data lines into analog video signals in each horizontal scan period. The data lines electrically connected to the first digital-to-analog converter and the data line electrically connected to the second digital-to-analog converter are alternated at intervals of a given number.

In the flat panel display according to the first aspect, the data-line driver includes shift registers that correspond to the first and second digital-to-analog converters, respectively, and operate in parallel.

In the flat panel display according to the first aspect, the pixel switch elements, first and second digital-to-analog converters, and shift registers contain thin-film transistors involving polysilicon active layers.

A flat panel display according to a second aspect of this invention includes a display panel containing an array substrate, a counter substrate facing the array substrate, and a light modulation layer interposed between the array substrate and the counter substrate. The array substrate includes a matrix of data lines and scan lines arranged on an insulating substrate, pixel switch elements arranged at the intersections of the data and scan lines, and pixel electrodes connected to the pixel switch elements. The flat panel display also includes a data-line driver arranged on the insulating substrate, for providing the data lines with corresponding analog video signals, and a scan-line driver for providing the scan lines with scan signals. The data-line driver includes a switch circuit for electrically connecting video bus lines arranged on the insulating substrate to corresponding ones of the data lines, and at least first, second, third, and fourth digital-to-analog converter ICs for sequentially converting digital video signals electrically connected to the video bus lines into analog video signals. The data lines electrically connected to the first digital-to-analog converter, the data lines electrically connected to the second digital-to-analog converter, and the data lines electrically connected to the third digital-to-analog converter are alternately arranged at intervals of a given number.

A flat panel display according to a third aspect of this invention includes a display panel containing an array substrate, a counter substrate facing the array substrate, and a light modulation layer interposed between the array substrate and the counter substrate. The array substrate includes a matrix of data lines and scan lines arranged on an insulating substrate, pixel switch elements arranged at the intersections of the data and scan lines, and pixel electrodes connected to the pixel switch elements. The flat panel display also includes a data-line driver arranged on the insulating substrate, for providing the data lines with corresponding analog video signals, and a scan-line driver for providing the scan lines with scan signals. The data-line driver includes a switch circuit for electrically connecting video bus lines arranged on the insulating substrate to corresponding ones of the data lines, and at least first, second, third, and fourth digital-to-analog converter ICs for sequentially converting digital video signals electrically connected to the video bus lines into analog video signals. The data lines electrically connected to the first digital-to-analog converter, the data lines electrically connected to the second digital-to-analog converter, the data lines electrically connected to the third digital-to-analog converter, and the data lines electrically connected to the fourth digital-to-analog converter are alternately arranged at intervals of a given number.

In the flat panel display according to the third aspect, the first and second digital-to-analog converter ICs provide positive analog video signals based on a reference voltage, and the third and fourth digital-to-analog converter ICs provide negative analog video signals based on the reference voltage.

The switch circuit switches relationships between the video bus lines and the corresponding data lines at predetermined intervals.

In the flat panel display according to the third aspect, the pixel switch elements and switch circuit contain thin-film transistors having polysilicon active layers.

In the flat panel display according to the third aspect, the first to fourth digital-to-analog converter ICs are formed on an external driver circuit board.

When the flat panel displays according to the first to third aspects employ a plurality of data-line drivers for driving one of large blocks divided from a screen, they connect adjacent signal lines to different data-line drivers. This distributes output variations of the data-line drivers, i.e., variations of driver ICs to a whole screen. As a result, no boundary between the driver ICs appears on the screen, thereby properly displaying images.

BRIEF DESCRIPTION OF DRAWINGS

FIG. 11 is an explanatory view showing an arrangement of video signal data rearranged by a control IC.

BEST MODE OF IMPLEMENTATION OF INVENTION

A flat panel display, e.g., a liquid crystal display according to an embodiment of the present invention will be explained.

The liquid crystal display of this embodiment has an active matrix liquid crystal panel. Drivers integrated in the liquid crystal panel, which is employed as p-Si TFTs.

Figure 5:
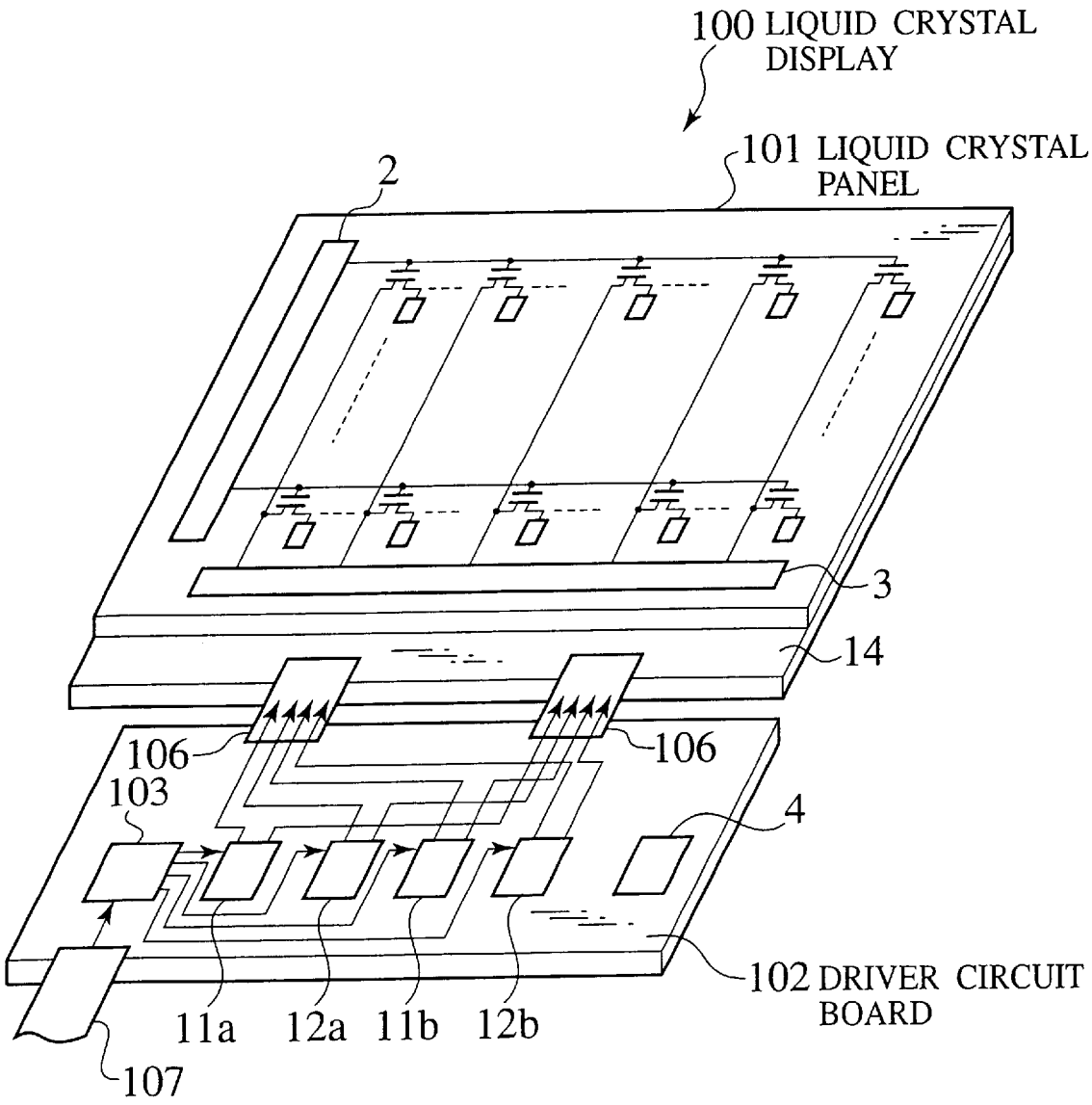
FIG. 5 is a block diagram generally showing a liquid crystal display according to an embodiment.

FIG. 5 is a block diagram generally showing the liquid crystal display of this embodiment. The liquid crystal display 100 has the liquid crystal panel 101 containing part of the drivers, a driver circuit board (PCB) 102 for supplying analog video signals to the liquid crystal panel 101, and flexible wiring boards (FPCs) 106 for electrically connecting the above-mentioned boards to each other.

Figure 6:
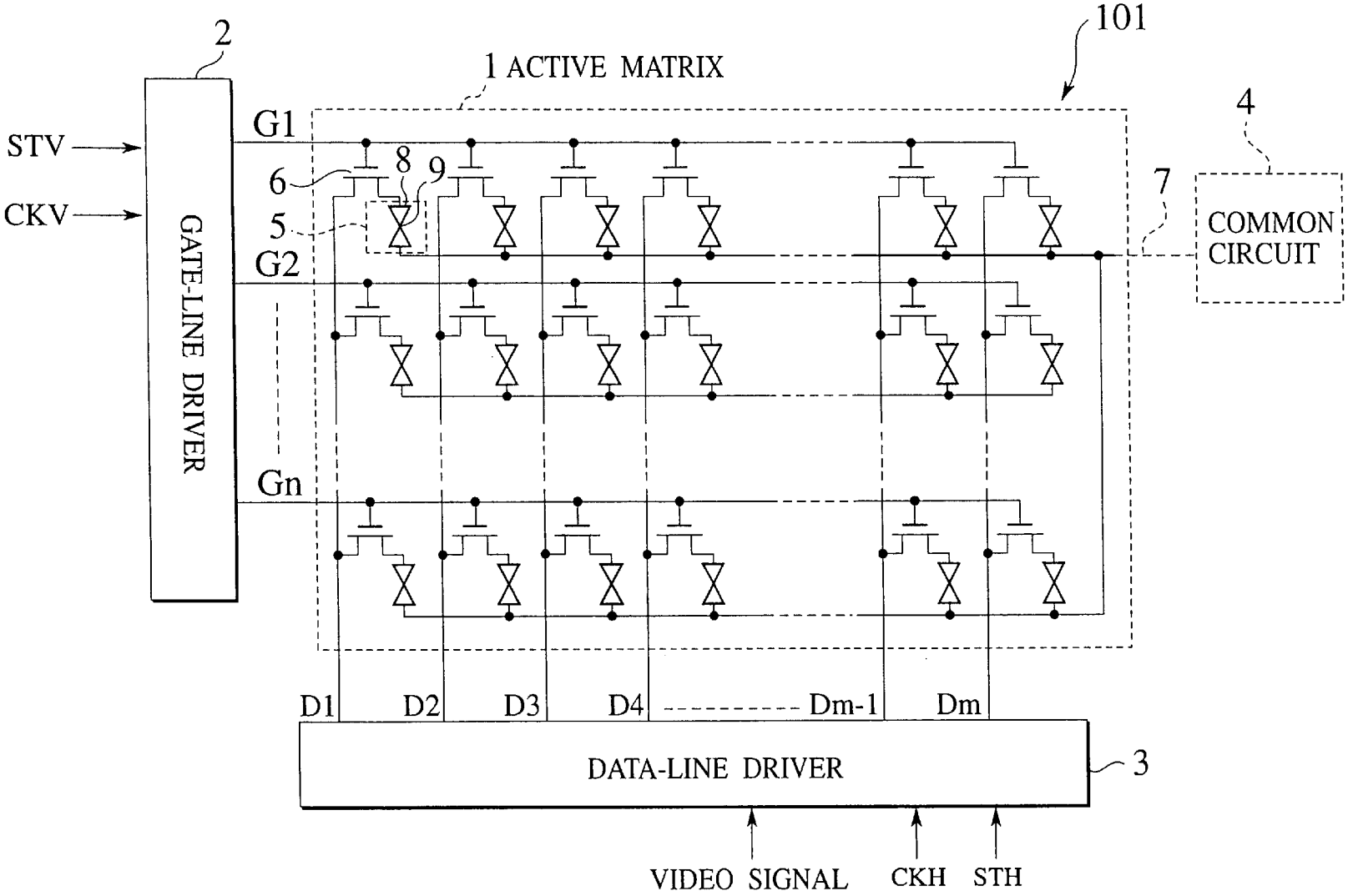
FIG. 6 is a circuit diagram showing a liquid crystal panel.

FIG. 6 is a circuit diagram showing the liquid crystal panel 101. The liquid crystal panel 101 has an active matrix 1, a gate-line driver 2, and a data-line driver 3. The drivers 2 and 3 drive the active matrix 1. All elements of the gate-line driver 2 are formed on the liquid crystal panel 101. Elements of the data-line driver 3 are partly formed on the liquid crystal panel 101. The arrangement of the data-line driver 3 will be explained later.

A common circuit (counter electrode driver) 4 is arranged on the driver circuit board 102 as shown in FIG. 5. For the sake of easy explanation, it is shown in FIG. 6.

The active matrix 1 has a matrix of liquid crystal pixels 5. Each of the liquid crystal pixels 5 has a counter electrode 7, a pixel electrode 8, and a liquid crystal layer 9 held between these electrodes. The supply of a video signal to each pixel electrode 8 is controlled by a TFT 6 serving as a switch element. Rows of the gates of the TFTs 6 are connected to gate lines (scan lines) G1, G2, . . . , Gn, respectively. Columns of the drains of the TFTs 6 are connected to data lines D1, D2, . . . , Dm, respectively. The source of the TFT 6 is connected to the pixel electrode 8. The counter electrodes 7 of all liquid crystal pixels 5 are connected to the common circuit 4.

The gate-line driver 2 contains shift registers and buffers (not shown). In response to a vertical synchronizing signal STV and a vertical clock signal CKV, the gate-line driver 2 provides the gate lines G1, G2, . . . , Gn with address signals. The gate-line driver 2 is entirely formed on an insulating substrate 14.

The data-line driver 3 has a sample-and-hold circuit for sequentially sampling, at predetermined timing, analog video signals to be supplied to the data lines D1, D2, . . . , Dm, a shift register for controlling the timing of the sample-and-hold circuit, a switch circuit for polarity inversion to be explained later, video bus lines for providing the switch circuit with analog video signals, and positive and negative D/A converters for converting externally provided digital video signals into analog video signals and sequentially supplying them to the video bus lines. The liquid crystal display 100 includes a control IC, which provides the data-line driver 3 with a horizontal synchronizing signal STH, a horizontal clock signal CKH, and digital video signals.

The sample-and-hold circuit, shift register, and video bus lines of the data-line driver 3 of this embodiment are integrally formed on the insulating substrate 14. The positive and negative D/A converters are arranged as IC chips on the driver circuit board 102 as shown in FIG. 5. Although this embodiment arranges the positive and negative D/A converters on the driver circuit board 102, they may be arranged on the insulating substrate 14.

The driver circuit board 102 of FIG. 5 has the control IC 103, positive D/A converters 11*a* and 11*b*, negative D/A converters 12*a* and 12*b*, and common circuit 4. The driver circuit board 102 is connected to a processor of a personal computer (not shown) through an FPC 107.

In the data-line driver 3, the sample-and-hold circuit, shift register, and video bus lines are each internally divided into four parallel parts as will be explained later. The TFTs 6 and gate-line driver 2 on the insulating substrate 14 and part of the data-line driver 3 are made of p-Si TFTs.

Figure 7:
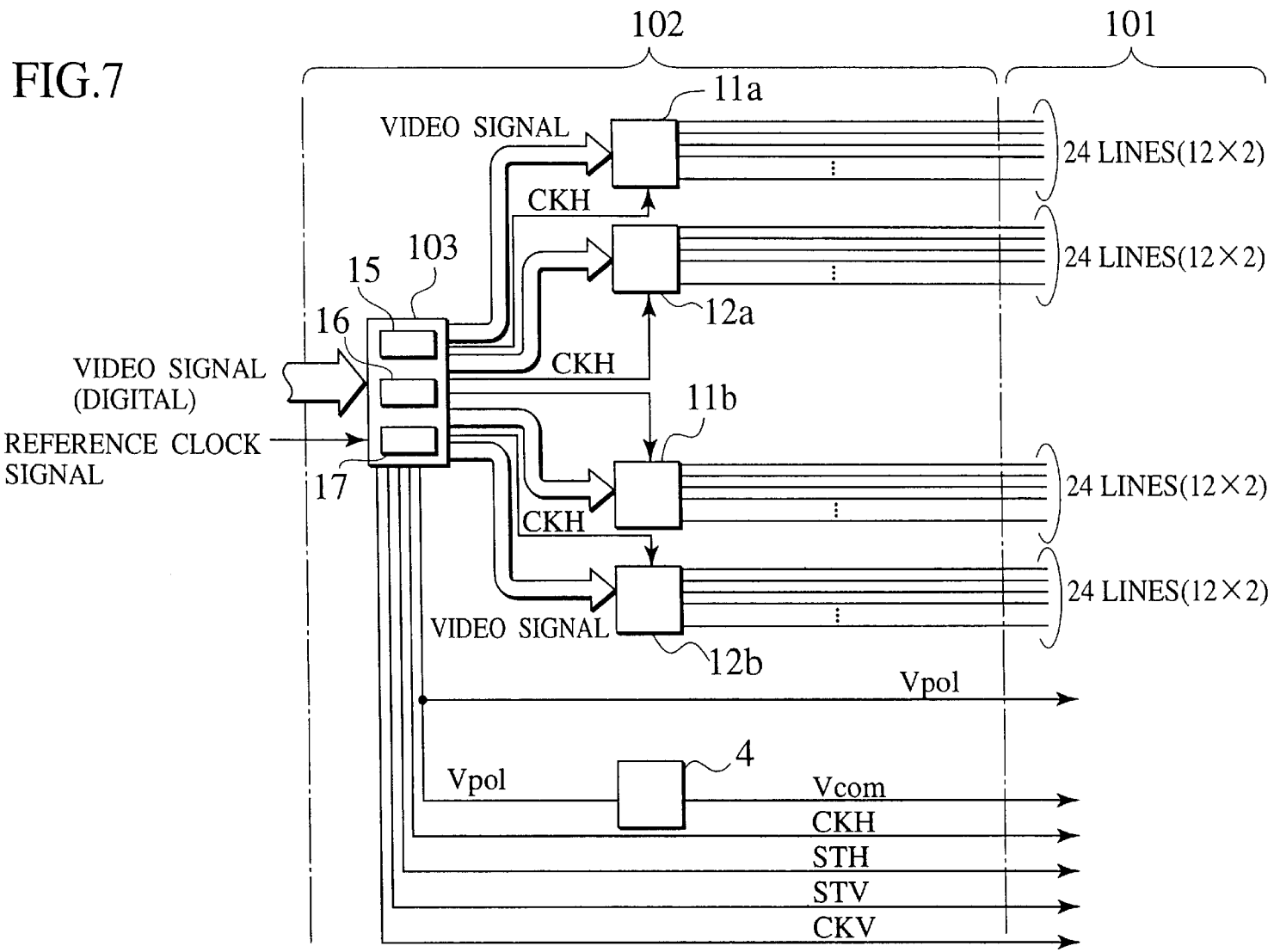
FIG. 7 is a circuit diagram showing a driver circuit board.

FIG. 7 is a circuit diagram showing the driver circuit board 102. The control IC 103 receives digital video signals, a reference clock signal, and a composite synchronizing signal (not shown) from the processor of the personal computer (not shown). The digital video signals are provided for every horizontal scan period and are sequential data for 1024 pixels, i.e., 3072 R, G, and B dots.

The control IC 103 includes a rearrangement circuit 15, a selective output circuit 16, and a control signal generator 17. The rearrangement circuit 15 receives digital video signals from the external processor and rearranges them for polarity inversion. The rearrangement circuit 15 includes a 2-line memory (not shown). The selective output circuit 16 provides the positive and negative D/A converters with video signals according to the polarities of the video signals in a given frame. The control signal generator 17 receives the reference clock signal and composite synchronizing signal (not shown) supplied with digital video signals from the external processor (not shown), generates various control signals such as a polarity inversion signal (Vpol) and clock signals based on the received signals, and outputs the generated signals.

The positive D/A converters 11*a* and 11*b* and negative D/A converters 12*a* and 12*b* convert digital video signals from the control IC 103 into analog video signals and supply them to the video bus lines (not shown) of the liquid crystal panel 101.

In the liquid crystal panel 101 of this embodiment, a display screen is divided into four areas (large blocks) along the data lines as will be explained later. Each of the four areas receives 24 positive and negative video signals in parallel. The positive D/A converters 11*a* and 11*b* supply 48 positive video signals in total, i.e., 12 positive video signals to each of the four areas. The negative D/A converters 12*a* and 12*b* supply 48 negative video signals in total, i.e., 12 negative video signals to each of the four areas.

The positive D/A converters 11*a* and 11*b* of FIG. 7 incorporate each 24 positive D/A converter units (not shown). The negative D/A converters 12*a* and 12*b* incorporate each 24 negative D/A converter units (not shown).

Connections between the positive D/A converters 11*a* and 11*b* and negative D/A converters 12*a* and 12*b* and the video bus lines will be explained in detail later.

Polarity inversion for the liquid crystal panel of the active matrix liquid crystal display mentioned above will be explained.

A standard liquid crystal display maintains the properties of a liquid crystal layer by inverting, frame by frame, the polarity of a potential difference applied between pixels and counter electrodes of a liquid crystal panel. Such polarity inversion is achieved by, for example, a V (vertical) line inversion technique that inverts the polarity of a potential difference applied between pixels and counter electrodes at intervals of adjacent vertical pixel lines (column by column), or by an H/V (horizontal/vertical) line inversion technique that inverts the polarity of a potential difference applied between pixels and counter electrodes at intervals of adjacent pixels.

To drive liquid crystals, a voltage of about ±5 V is usually required. The inversion techniques mentioned above, therefore, need a withstand voltage of 10 V as the output of a driver, to hardly reduce power consumption. To reduce power consumption, several liquid crystal displays have been proposed.

For example, Japanese Unexamined Patent Publication No. 9-186151 discloses a display having D/A converters for converting serial digital video signals externally provided into parallel signals and then into analog signals, and amplifiers connected to the D/A converters, respectively. The amplifiers connected to adjacent D/A converters are connected to source voltages of opposite polarities. Each of the amplifiers is connected to a switch pair. Switches of each switch pair are connected to data lines, respectively. According to this arrangement, a driver is operated with a withstand voltage of a single polarity, to reduce power consumption. Adjacent signal lines can share a display signal bus, to reduce the number of display signal buses, thereby reducing a circuit scale.

According to the display of the Japanese Unexamined Patent Publication No. 9-186151, odd-numbered D/A converters drive, in a given frame period, odd-numbered data lines and even-numbered D/A converters drive even-numbered data lines. In the next frame period, the odd-numbered D/A converters drive the even-numbered data lines, and the even-numbered D/A converters drive the odd-numbered data lines. To realize such polarity inversion, an external memory is prepared to rearrange video signals for a given frame. A method of driving the liquid crystal panel 101 to be explained below employs a polarity inversion technique similar to that of the display of the Japanese Unexamined Patent Publication No. 9-186151 and rearranges video signals.

A basic method of driving the liquid crystal panel 101 related to this embodiment will be explained.

Figure 8:
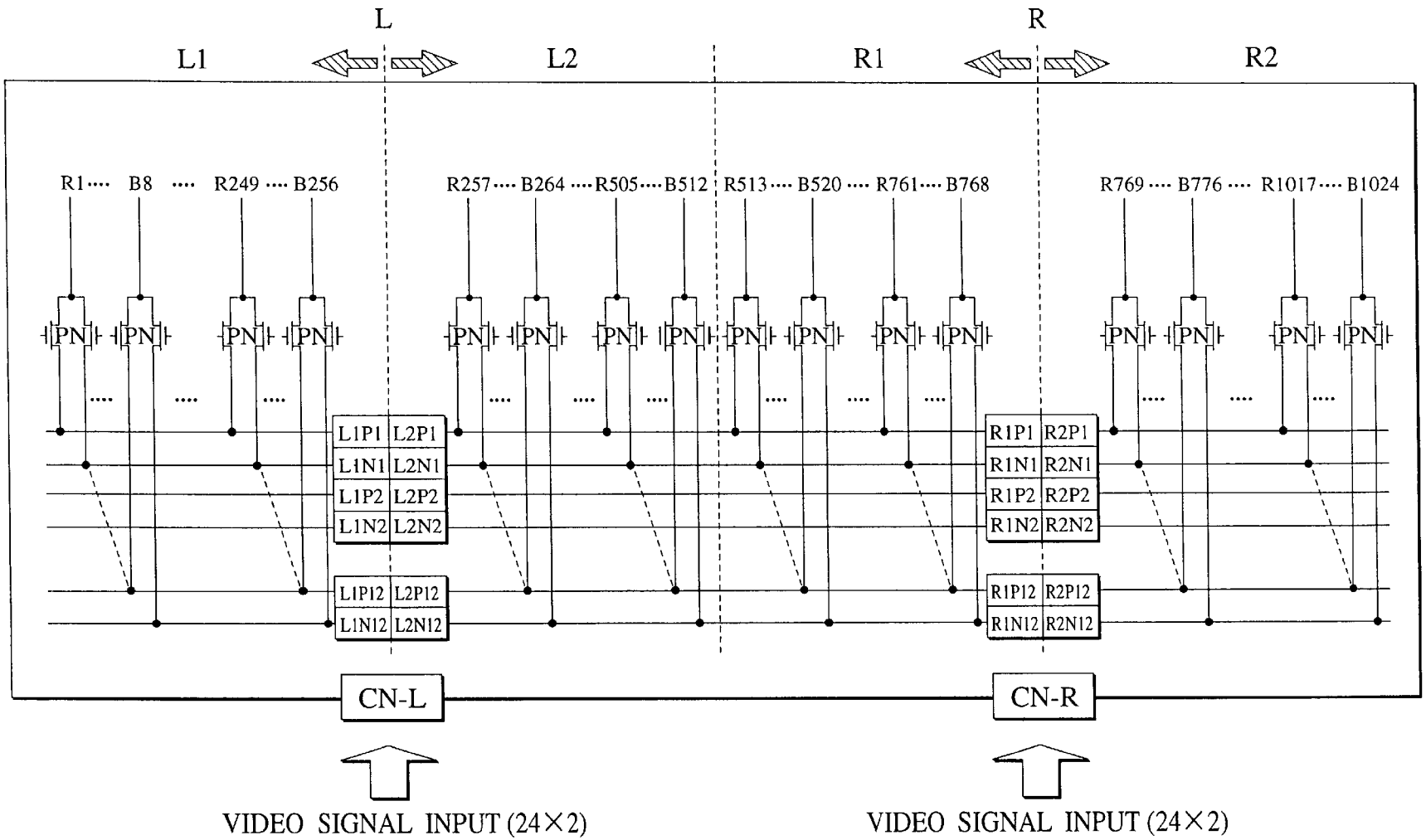
FIG. 8 is a wiring diagram explaining a driving method of a liquid crystal panel according to an embodiment.

FIG. 8 is a wiring diagram explaining the method of driving the liquid crystal panel 101 related to this embodiment and mainly shows relationships between data lines and internal wires (video bus lines) connected to the data lines.

According to this embodiment, the display screen made of the active matrix 1 in the liquid crystal panel 101 is divided into four areas along the data lines. In FIG. 8, L1, L2, R1, and R2 are the divided areas, respectively. Video signals supplied to the areas are simultaneously scanned in the directions of arrow marks around left and right two lines (line L and line R) among three lines that divide the screen into the four areas. This eliminates discontinuity along each boundary of the divided areas.

To achieve such scanning, the data-line driver 3 (FIG. 6) is electrically divided into four parallel parts. Namely, circuits such as the shift register and sample-and-hold circuit that form the data-line driver 3 are each divided into four parts, which are provided for the divided areas, respectively. The four areas of this embodiment simultaneously sample and output video signals, to elongate a shift register sampling time four times that of sequentially sampling a screen with a single shift register. As a result, this embodiment properly displays images.

CN-L and CN-R of FIG. 8 receive analog video signals from the driver circuit board 102 (FIG. 5). The CN-L and CN-R receive 24 video signals to be supplied to each of the areas. Namely, the CN-L receives 48 (24×2) video signals to be supplied to the areas L1 and L2, and the CN-R receives 48 (24×2) video signals to be supplied to the areas R1 and R2.

The video signals supplied to the liquid crystal panel 101 are passed through 24 video bus lines (for example, L1P1, L1N1, . . . , L1N12) distributed to each area and are supplied to a switch circuit (113) to be explained later. The video bus lines include alternately arranged positive and negative video signal lines. Among the video bus lines of FIG. 8, the positive lines have each "P" and the negative lines have each "N." For.example, the video bus line L1P1 is a positive line, and L1N1 is a negative line.

Figure 9:
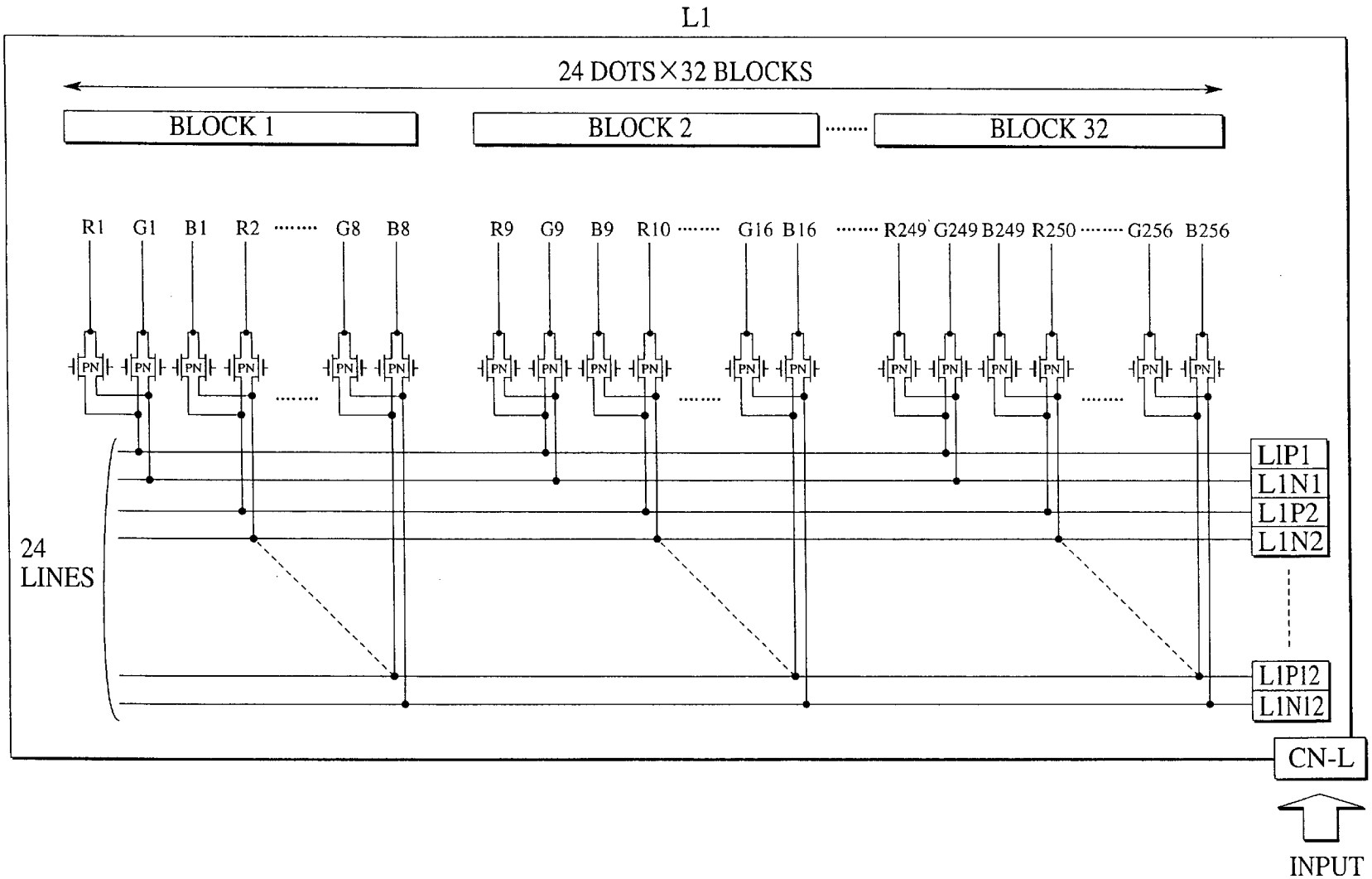
FIG. 9 is a partial enlarged view showing an area L1 shown in FIG. 6.

FIG. 9 is a partial enlarged view showing the area L1 of FIG. 8. The inside of each area is divided into 32 blocks (small blocks), and each block contains eight pieces of R data, eight pieces of G data, and eight pieces B data.

For example, the block 1 contains R1 to R8, G1 to G8, and B1 to B8, the block 2 contains R9 to R16, G9 to G16, and B9 to B16, and the block 32 contains R249 to R256, G249 to G256, and B249 to B256.

In this way, each block contains eight pieces of R data, eight pieces of G data, and eight pieces of B data and simultaneously samples 24 video signals. As shown in FIG. 9, 32 blocks are sequentially sampled one by one, so that each area may sample and output video signals.

For example, sampling is carried out from the block 32 toward the block 1 in FIG. 9, and in the area L1 of FIG. 8, video signals are sequentially sampled from B256 toward R1. In the other areas, the sampling is carried out in a like manner. In this way, each area samples 24×32=768 pixels, and therefore, the four areas sample 3072 pixels in total in each horizontal scan period. This sampling is repeated for all scan lines, to sequentially write video signals into a frame of pixels.

This embodiment employs the V line inverting technique for driving the liquid crystal panel 101. Namely, in each frame period, the data-line driver 3 drives the data lines such that the potentials of adjacent data lines have opposite polarities with respect to a reference voltage, and at the same time, inverts the polarity of each data line frame by frame. The driving method of the liquid crystal panel 101 is not limited to the V line inverting technique. For example, the H line inverting technique and the H/V inverting technique are employable.

Figure 10:
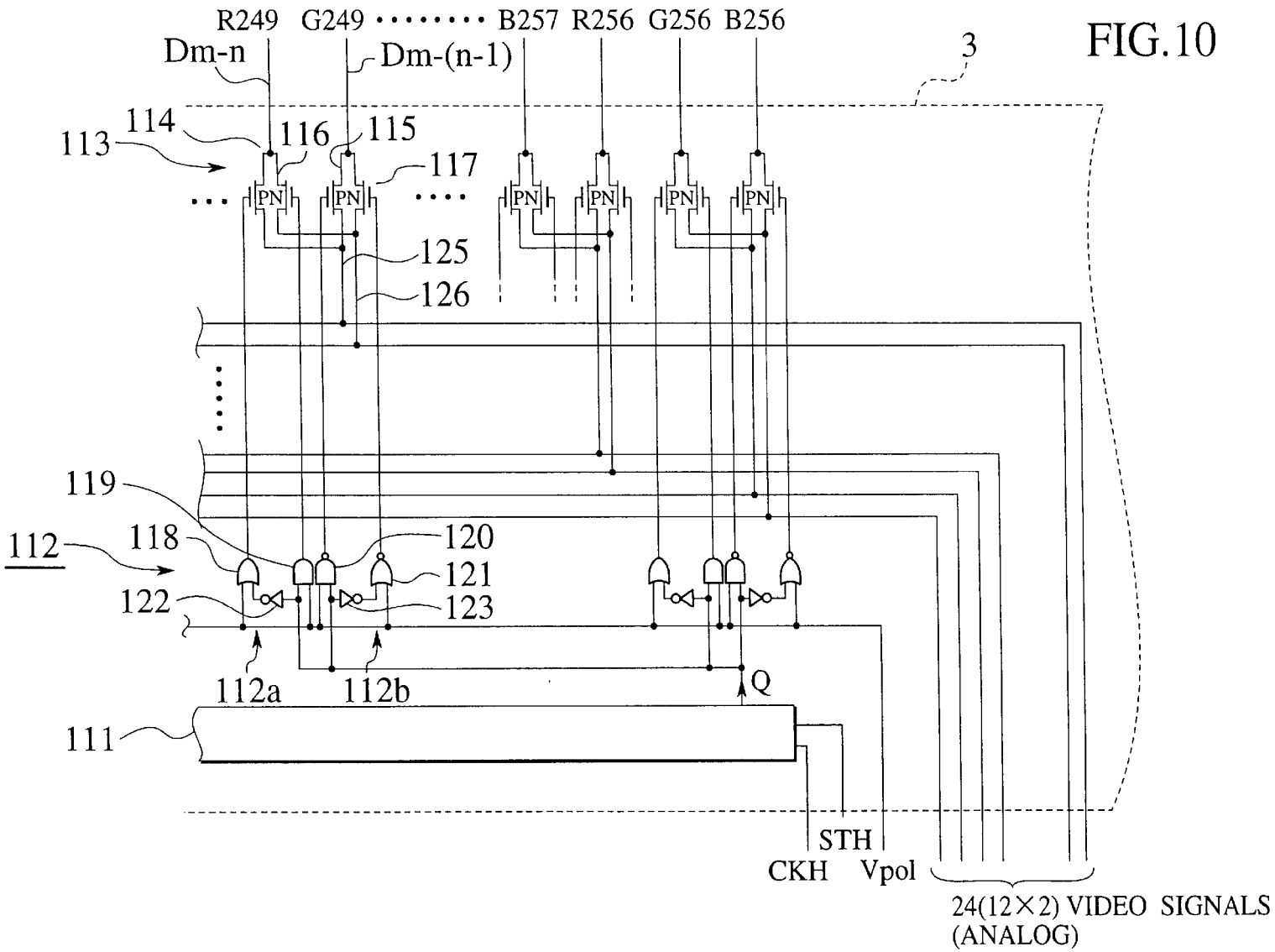
FIG. 10 is a partial circuit diagram showing a data-line driver.

FIG. 10 is a partial circuit diagram showing the data-line driver 3, corresponding to the area L1 of FIG. 8. The data-line driver 3 of this embodiment is divided into four parallel parts corresponding to the four divided areas. FIG. 10 shows one of the four parallel parts.

The data-line driver 3 includes a shift register 111 and a sample-and-hold circuit 112 for sampling analog video signals in response to an output Q of the shift register 111. These circuits sequentially sample analog video signals supplied from the driver circuit board 102 (FIG. 5) in synchronization with the horizontal clock signal CKH and write the signals into data lines.

The output Q of the shift register 111 is supplied to an odd-numbered signal switching circuit 112*a* and an even-numbered signal switching circuit 112*b*. A video bus line 125 receives positive R, G, and B analog signals, and a video bus line 126 receives negative R, G, and B analog signals.

Each switch circuit 113 has pairs of p- and n-channel transistors. The positive video bus line 125 is connected to data lines Dm-n and Dm- (n−1) through the p-channel transistors 114 and 115. On the other hand, the negative video bus line 126 is connected to the data lines Dm-n and Dm- (n−1) through the n-channel transistors 116 and 117.

The gate of the p-channel transistor 114 is connected to an output terminal of an OR gate 118. The gate of the n-channel transistor 116 is connected to an output end of an AND gate 119. The gate of the p-channel transistor 115 is connected to an output end of a NAND gate 120. The gate of the n-channel transistor 117 is connected to an output end of a NOR gate 121.

The OR gate 118, AND gate 119, NAND gate 120, and NOR gate 121 receive a polarity inverting signal Vpol. The AND gate 119 and NAND gate 120 are connected to the output Q of the shift register 111. The OR gate 118 is connected to the output Q of the shift register 111 through an inverter 122. The NOR gate 121 is connected to the output Q of the shift register 111 through an inverter 123. In synchronization with the horizontal clock signal CKH, the shift register 111 sequentially shifts the horizontal synchronizing signal STH. The shift register 111 provides the output Q according to the horizontal synchronizing signal STH.

The operation of the circuit of FIG. 10 will be explained. Here, the operations of the adjacent data lines Dm-n and Dm- (n−1) and the switch circuit 113 and signal switching circuits 112*a* and 112*b* connected thereto will be explained. The polarity inverting signal Vpol supplied to the signal switching circuits 112*a* and 112*b* indicates a positive polarity when it is low level and a negative polarity when it is high level. The polarity inverting signal Vpol is switched frame by frame.

If the polarity inverting signal Vpol is at low level, the OR gate 118 passes the output Q of the shift register 111, and the output of the AND gate 119 becomes low. The output of the NAND gate 120 becomes high, and the NOR gate 121 inverts and passes the output Q. As a result, the p-channel transistor 114 becomes conductive due to the output Q of the shift register 111, and the n-channel transistor 116 and p-channel transistor 115 become nonconductive. The n-channel transistor 117 become conductive due to the output Q of the shift register 111. As a result, a positive video signal is written into the data line Dm-n according to the output Q of the shift register 111. On the other hand, a negative video signal is written into the data line Dm- (n−1) according to the output Q of the shift register 111.

If the polarity inverting signal Vpol is at high level, the OR gate 118 becomes high, and the AND gate 119 passes the output Q. The NAND gate 120 inverts and passes the output Q, and the output of the NOR gate 121 becomes low. As a result, the p-channel transistor 114 becomes nonconductive, and the n-channel transistor 116 becomes conductive according to the output Q of the shift register 111. The p-channel transistor 115 becomes conductive according to the output Q from the shift register 111, and the n-channel transistor 117 becomes nonconductive. As a result, a negative video signal is written into the data line Dm-n according to the output Q from the shift register 111. On the other hand, a positive video signal is written into the data line Dm- (n−1) according to the output Q from the shift register 111.

The above operations are repeated frame by frame, to alternately write positive and negative video signals into the adjacent data lines Dm-n and Dm- (n−1). Among the other data lines, positive and negative video signals are alternately written into adjacent data lines. In the above-mentioned circuit configuration, the video bus line 125 receives only a positive video signal, and the video bus line 126 receives only a negative video signal. This arrangement is capable of driving each gate element of the sample-and-hold circuit 112 with a single polarity withstand voltage, to reduce power consumption.

FIG. 11 is an explanatory view showing an arrangement of video signal data rearranged by the control IC 103 (FIG. 7). The right side of the figure shows data strings of video signals for one line supplied from the processor and rearranged for the blocks 1 to 32 of the areas L1, L2, R1, and R2. The left side of the figure shows the polarity (Pol) of the polarity inverting signal and rules for distributing video signals to the video bus lines. "Pol =0" (low level) represents a signal distribution with the polarity inverting signal indicating a positive polarity, and "Pol =1" (high level) represents a signal distribution with the polarity inverting signal indicating a negative polarity.

Data distribution will be explained in connection with the block 1 of the area L1 as an example. If the polarity inverting signal indicates Pol =0, the video bus line L1P1 of the block 1 receives R249, and L1N1 receives G249. The video signal R249 is passed through the p-channel transistor 114 of FIG. 10 and is written into the data line Dm-n. The video signal G249 is passed through the n-channel transistor 117 of FIG. 10 and is written into the data line Dm- (n−1). On the other hand, if the polarity inverting signal indicates Pol =1, the video bus line L1P1 of the block 1 receives G249, and L1N1 receives R249. The video signal G249 is passed through the p-channel transistor 115 of FIG. 10 and is written into the data line Dm- (n−1). The video signal R249 is passes through the n-channel transistor 116 of FIG. 10 and is written into the data line Dm-n.

By carrying out the data rearrangement shown in FIG. 11, the video bus line 125 of FIG. 10. always receives a positive video signal, and the video bus line 126 always receives a negative video signal. Namely, the adjacent data lines Dm-n and Dm- (n−1) always receive video signals of the same polarities, respectively, although the polarities of video signals are inverted frame by frame.

Characteristic arrangements of drivers for the liquid crystal panel 101 will be explained.

Figure 1:
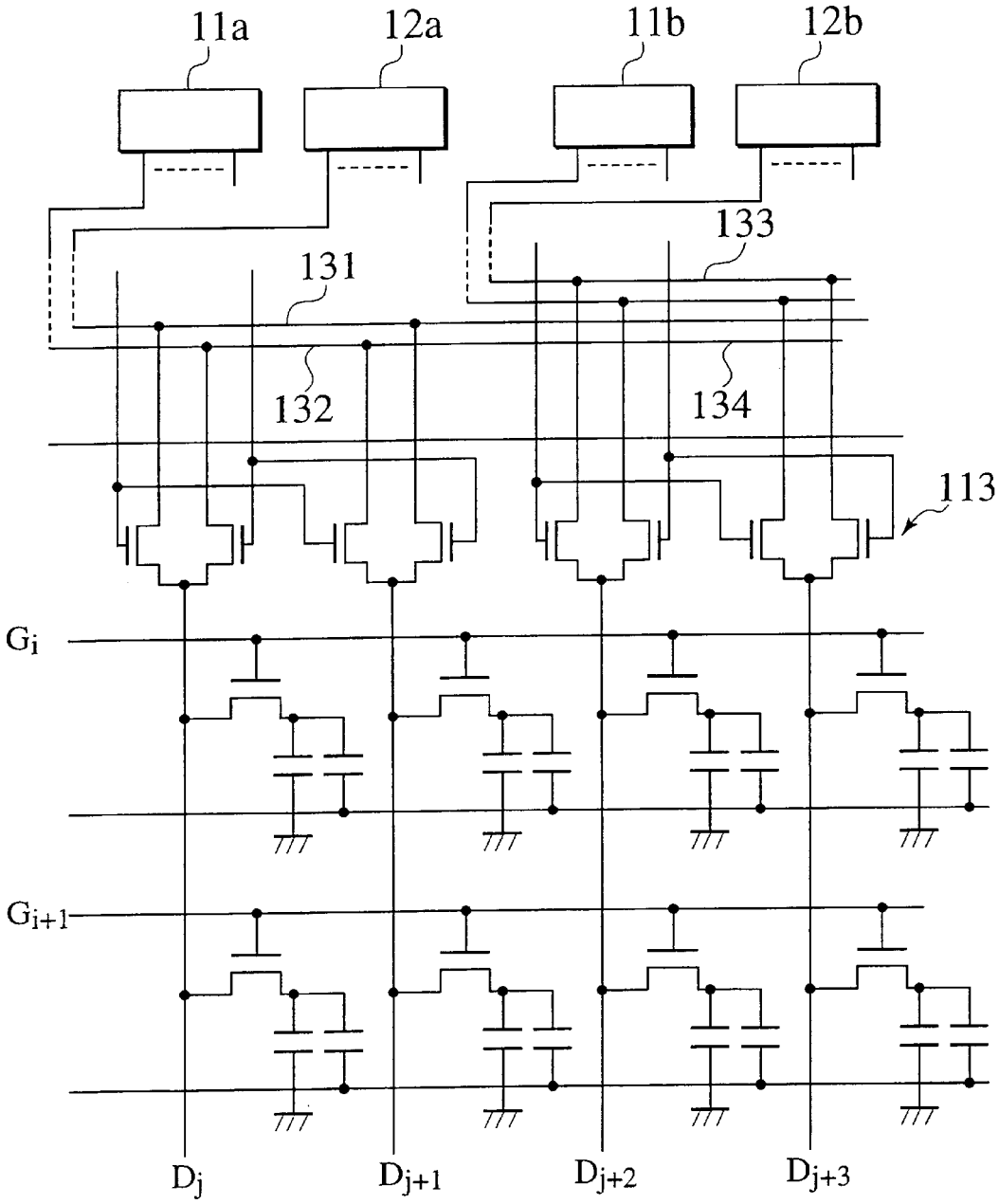
FIG. 1 is a conceptual view showing connections among liquid crystal pixels, video bus lines, and D/A converters.

FIG. 1 is a conceptual view showing connections among the liquid crystals, video bus lines, and D/A converters mentioned above, and specifically showing gate lines G1 and Gi+1 and data lines Dj to Dj+3. Circuits up to those for supplying video signals to the D/A converters and those formed on the insulating substrate are not shown. Other circuits including the sample-and-hold circuit are also not shown.

In FIG. 1, the data lines Dj and Dj+1 among the data lines Dj, Dj+1, Dj+2, and the like are connected to video bus lines 131 and 132 that are connected to the positive D/A converter 11*a* and negative D/A converter 12*a*. The data lines Dj+2 and Dj+3 are connected to video bus lines 133 and 134 that are connected to the positive D/A converter 11*b* and negative D/A converter 12*b*. If there are four D/A converters like this embodiment, the next two data lines (Dj+4, Dj+5) (not shown) are connected to the video bus lines 131 and 132, and the further next two data lines (Dj+6, Dj+7) are connected to the video bus lines 133 and 134. Namely, adjacent two data lines and two video bus lines for supplying positive and negative video signals form a positive-negative set, and such sets are alternately arranged.

In the above arrangement, alternately writing positive and negative video signals into adjacent data lines will be considered. The data lines to which positive video signals are written alternately receive data from the positive D/A converters 11*a* and 11*b*, and the data lines to which negative video signals are written alternately receive data from the negative D/A converters 12*a* and 12*b*.

Even if the positive D/A converters 11*a* and 11*b* or the negative D/A converters 12*a* and 12*b* involve output variations, contrast unevenness will appear on every second data line, to distribute the unevenness to the whole screen and make the unevenness unrecognizable. Even on a monotone image, borders due to contrast unevenness will be inconspicuous, thereby properly displaying images.

For the sake of easy explanation, this embodiment employs four D/A converters. The connections mentioned above are applicable to a case involving more D/A converters.

Figure 2:
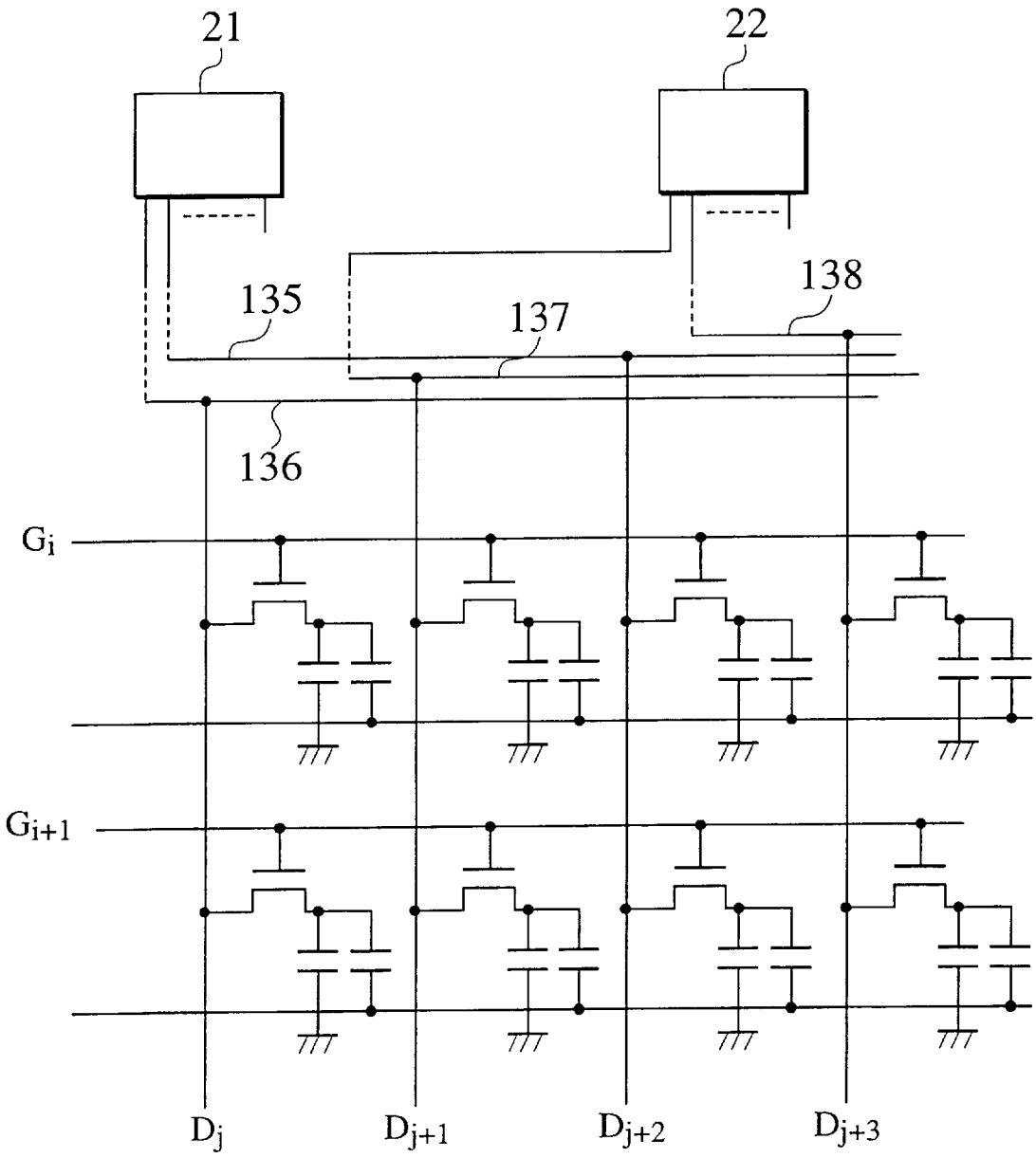
FIG. 2 is a conceptual view showing another embodiment based on FIG. 1.

FIG. 2 is a conceptual view showing another embodiment and specifically showing connections among liquid crystal pixels, video bus lines, and D/A converters, like FIG. 1. In FIG. 2, there are shown gate lines Gi and Gi+1 and data lines Dj to Dj+3. Circuits up to those for supplying video signals to the D/A converters and those formed on the insulating substrate are not shown. The other circuits are also not shown.

The D/A converters 21 and 22 of FIG. 2 are each structured to supply positive and negative video signals by inverting the polarities of video signals frame by frame.

Among the data lines Dj, Dj+1, Dj+2, and the like, the data lines Dj and Dj+2 are connected to video bus lines 135 and 136 that are connected to the D/A converter 21, and the data lines Dj+1 and Dj+3 are connected to video bus lines 137 and 138 that are connected to the D/A converter 22. If the data line Dj is an even-numbered data line, even-numbered data lines such as Dj, Dj+2, and Dj+4 are connected to the D/A converter 21, and odd-numbered data lines such as Dj+1 and Dj+3 are connected to the D/A converter 22. In a given frame, the D/A converter 21 writes positive video signals into pixels (Dj, Gi), and the D/A converter 22 writes negative video signals into pixels (Dj+1, Gi). Then, in the next frame, the D/A converter 21 writes negative video signals into the pixels (Dj, Gi), and the D/A converter 22 writes positive video signals into the pixels (Dj+1, Gi). These processes are repeated.

According to the above arrangement, in a given frame, every second data line receives a positive video signal from the D/A converter 21, and the other data lines receive negative video signals from the D/A converter 22. In the next frame, every second data line receives a positive video signal from the D/A converter 22, and the other data lines receive negative video signals from the D/A converter 21.

Even if the D/A converters 21 and 22 involve output variations, contrast unevenness will appear on every second data line on a screen to distribute the unevenness over the screen and make the unevenness unrecognizable. Even on a monotone image, borders due to contrast unevenness will be inconspicuous, thereby properly displaying images.

Although the data-line driver 3 of any one of the embodiments mentioned above forms the sample-and-hold circuit, shift register, and video bus lines on the insulating substrate 14, the D/A converters (11, 12, 21, 22) may also be formed on the insulating substrate 14. The D/A converters arranged in next of shift registers (not shown). In addition, the control IC 103 may also be formed on the insulating substrate 14.

This embodiment employs two D/A converters configured to supply positive and negative video signals. The connections of this embodiment are applicable to a case employing more D/A converters each having the function mentioned above.

Another embodiment employing D/A converters capable of supplying positive and negative video signals will be explained.

Figure 3:
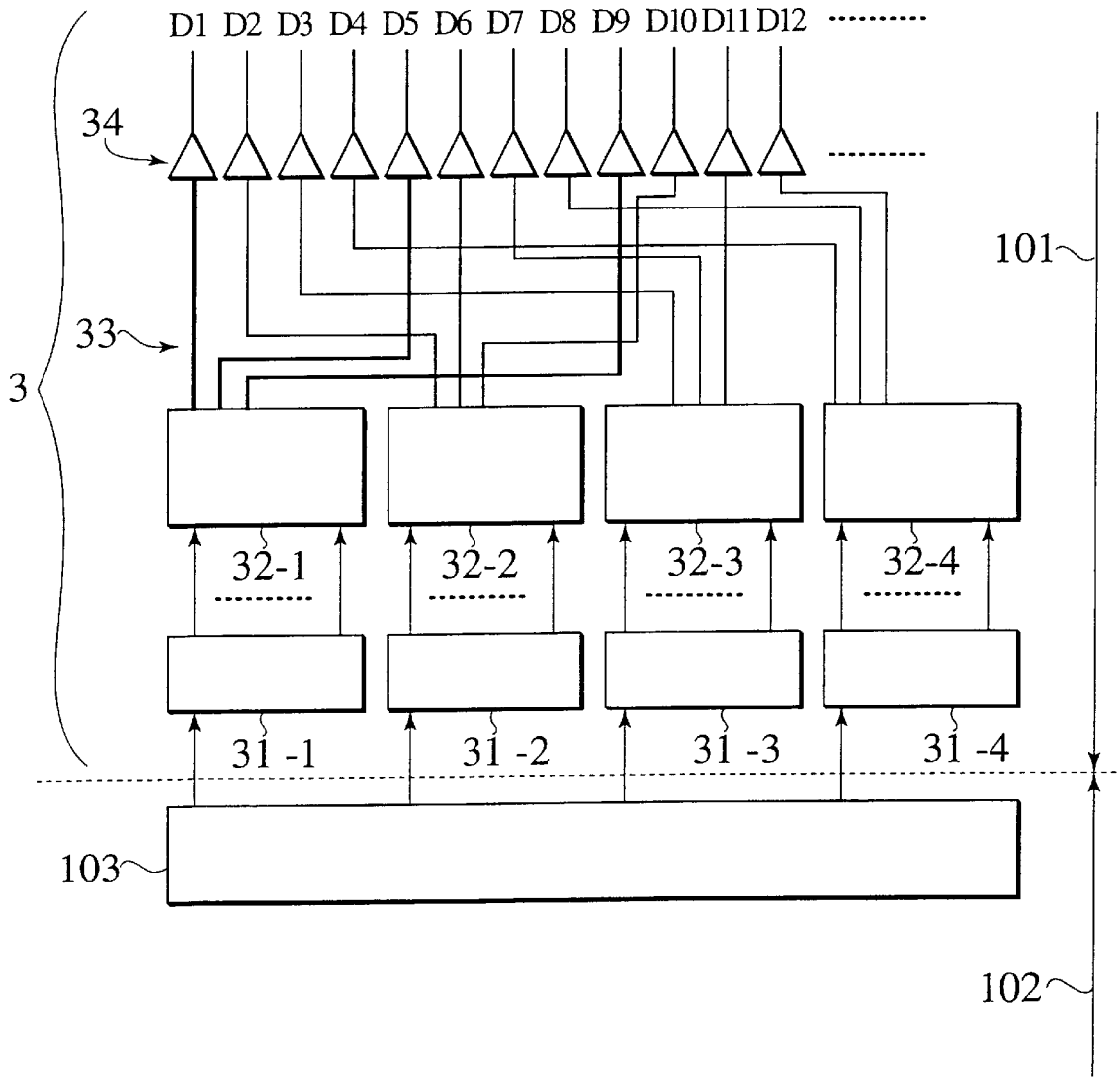
FIG. 3 is a conceptual view showing another embodiment based on FIG. 2.

FIG. 3 is a conceptual view showing another embodiment based on FIG. 2. FIG. 3 mainly shows the structure of the data-line driver 3. Parts equivalent to those of FIG. 2 are represented with like reference marks.

The data-line driver 3 of FIG. 3 has four D/A converters 32-1, 32-2, 32-3, and 32-4 each capable of supplying positive and negative video signals. These D/A converters simultaneously receive digital video signals from the control IC 103 through shift registers 31-1, 31-2, 31-3, and 31-4. The D/A converters 32-1, 32-2, 32-3, and 32-4 are connected to data lines D1, D2, D3, and the like through video bus lines 33 and data line driving amplifiers 34.

According to the circuit structure of FIG. 3, the D/A converter 32-1 is connected to the data lines D1, D5, D9, and the like, and the D/A converter 32-2 is connected to the data lines D2, D6, D10, and the like, to sequentially provide analog video signals. The D/A converter 32-3 is connected to the data lines D3, D7, D11, and the like, and the D/A converter 32-3 is connected to the data lines D4, D8, D12, and the like, to sequentially provide analog video signals.

According to this embodiment, the shift registers 31-1, 31-2, 31-3, and 31-4, D/A converters 32-1, 32-2, 32-3, and 32-4, video bus lines 33, and driving amplifiers 34 are integrally formed on the insulating substrate 14. The control IC 103 is formed on the driver circuit board 102.

According to the above-mentioned arrangement, adjacent data lines are connected to different D/A converters. Assuming that odd-numbered data lines receive positive video signals, and even-numbered data lines receive negative video signals, the odd-numbered data lines to receive positive video signals are connected to the outputs of the D/A converters 32-1 and 32-3 at intervals of two. The even-numbered data lines to receive negative video signals are connected to the outputs of the D/A converters 32-2 and 32-4 at intervals of two.

Even if the D/A converters 32-1, 32-2, 32-3, and 32-4 involve output variations, contrast unevenness appears every second data line on a screen, to distribute the contrast unevenness to the whole screen and make it unrecognizable. Even on a monotone image, borders due to contrast unevenness will be inconspicuous, thereby properly displaying images.

The data-line driver 3 of the above embodiment integrally forms the shift registers 31, D/A converters 32, video bus lines 33, and driving amplifiers 34 on the insulating substrate 14. The control IC 103 may also integrally be formed on the insulating substrate 14. In the data-line driver 3, only the video bus lines 33 and driving amplifiers 34 may be formed on the insulating substrate 14, and the remaining parts may be formed on the driver circuit board 102. Alternatively, the video bus lines 33, driving amplifiers 34, and D/A converters 32 may be formed on the insulating substrate 14, and the other parts on the driver circuit board 102.

For the sake of simplicity of explanation, this embodiment employs four D/A converters. The same connection configuration is applicable to a case with more D/A converters.

Still another embodiment employing D/A converters capable of providing positive and negative video signals will be explained.

Figure 4:
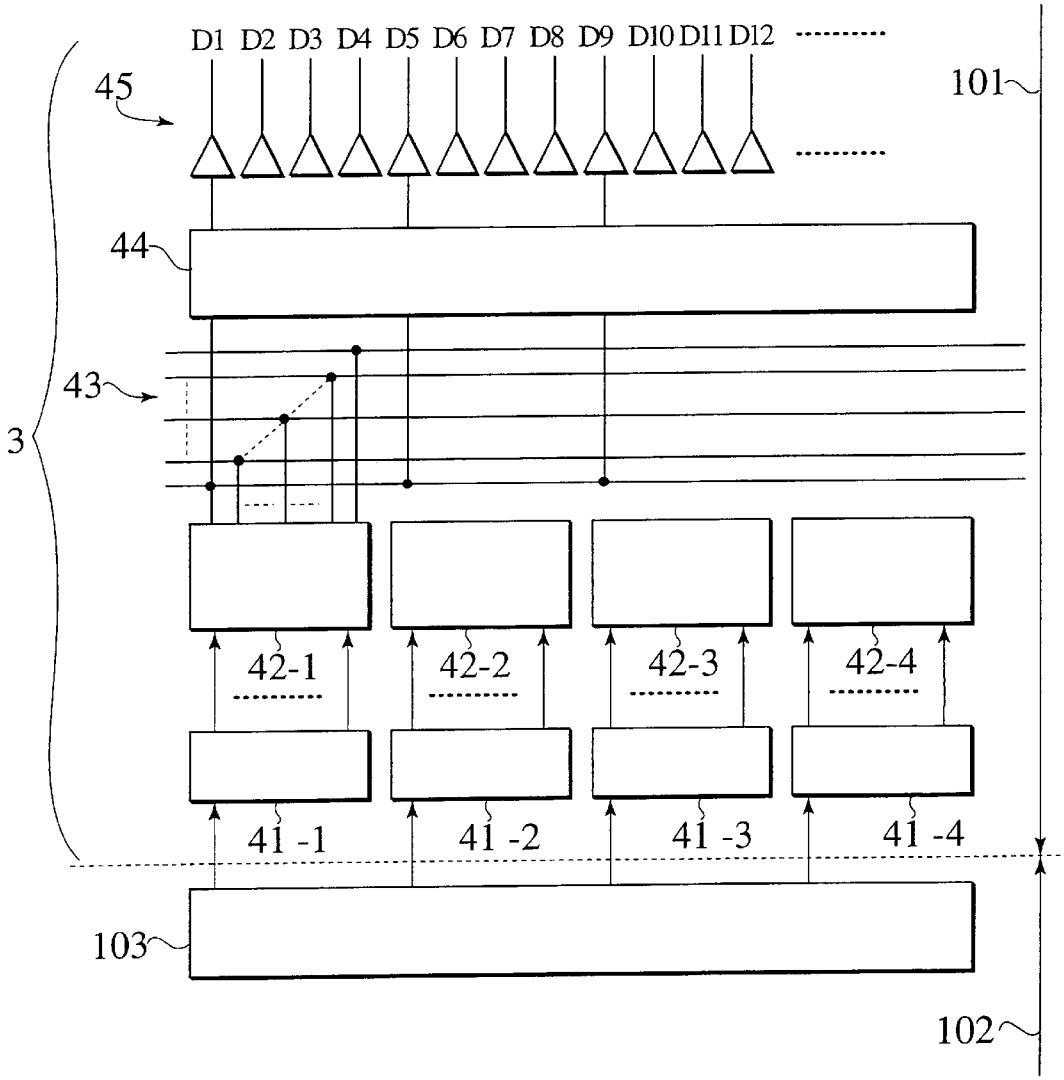
FIG. 4 is a conceptual view showing still another embodiment based on FIG. 2.

FIG. 4 is a conceptual view showing still another embodiment based on FIG. 2. FIG. 4 specifically shows the structure of the data-line driver 3. Parts equivalent to those of FIG. 2 are represented with like reference marks.

The data-line driver 3 of FIG. 4 includes four D/A converters 42-1, 42-2, 42-3, and 42-4 capable of supplying positive and negative video signals. These D/A converters receive digital video signals from the control IC 103 through shift registers 41-1, 41-2, 41-3, and 41-4. The D/A converters 42-1, 42-2, 42-3, and 42-4 are connected to the data lines D1, D2, D3, and the like through bus lines 43, a shift register 44, and data line driving amplifiers 45.

The outputs of the D/A converter 42-1 are distributed to the data lines D1, D2, D3, and the like through the bus lines 43. Similarly, the outputs (not shown) of the D/A converters 42-2, 42-3, and 42-4 are distributed to the data lines D1, D2, D2, and the like through bus lines (not shown).

In FIG. 4, the outputs of the D/A converter 42-1 are connected to the bus lines 43, respectively, and through which, to the data lines D1, D5, D9, and the like. Similarly, the outputs of the D/A converter 42-2 are connected to the data lines D2, D6, D10, and the like through the bus lines (not shown). The outputs of the D/A converter 42-3 are connected to the data lines D3, D7, D11, and the like through the bus lines (not shown), and the outputs of the D/A converter 42-4 are connected to the data lines D4, D8, D12, and the like through the bus lines (not shown).

In this embodiment, the shift registers 41-1, 41-2, 41-3, and 41-4, D/A converters 42-1, 42-2, 42-3, and 42-4, bus lines 43, shift register 44, and driving amplifiers 45 are integrally formed on the insulating substrate 14. The control IC 103 is formed on the driver circuit board 102.

According to the above arrangement, adjacent data lines are connected to different D/A converters. Supposing odd-numbered data lines are written with positive analog video signals, and even-numbered data lines are written with negative analog video signals, the odd-numbered data lines to which positive video signals are written are connected to the outputs of the D/A converters 42-1 and 42-3 at intervals of two. The even-numbered data lines to which negative video signals are written are connected to the outputs of the D/A converters 42-2 and 42-4 at intervals of two.

Even if the D/A converters 42-1, 42-2, 42-3, and 42-4 involve output variations, contrast unevenness appears along every second data line on a screen, to distribute the contrast unevenness to the entire screen and make it unrecognizable. Even on a monotone image, borders due to contrast unevenness will be inconspicuous, thereby properly displaying images.

When bus lines are used as shown in FIG. 4, the D/A converters may be formed in a distal area, to easily cause a driver IC offset during manufacturing. Accordingly, the circuit structure of this embodiment is effective to properly display images.

The data-line driver 3 of the above embodiment forms the shift registers 41, D/A converters 42, bus lines 43, shift register 44, and driving amplifiers 45 on the insulating substrate 14. The control IC 103 may also be formed on the insulating substrate 14. In the data-line driver 3, only the bus lines 43, shift register 44, and driving amplifiers 45 may be formed on the insulating substrate 14, and the remaining parts on the driver circuit substrate 102. Alternatively, the bus lines 43, shift register 44, driving amplifiers 45, and D/A converters 42 may be formed on the insulating substrate 14, and the remaining parts on the driver circuit board 102.

Although this embodiment employs four D/A converters, the connection configuration of the embodiment is also applicable to a case employing more D/A converters.

What is claimed is:

1. A flat panel display comprising:

a display panel having an array substrate including a matrix of data lines and scan lines arranged on an insulating substrate, pixel switch elements arranged at intersections of the data and scan lines, and pixel electrodes connected to the pixel switch elements, a counter electrode facing the pixel electrodes, and a light modulation layer interposed between the pixel electrode and the counter electrode;

a data-line driver arranged on the insulating substrate, for providing the data lines with corresponding analog video signals; and a scan-line driver arranged on the insulating substrate, for providing the scan lines with scan signals, the data-line driver including at least first and second digital-to-analog converters for sequentially converting digital video signals, which are supplied by shift registers in parallel, to analog signals, each of the first and second digital-to-analog converters connected to plural of data lines respectively, and giving analog video signals in each horizontal scan period to correspond data lines in accordance with the analog signals, the data line electrically connected to the first digital-to-analog converter and the data line electrically connected to the second digital-to-analog converter being alternated at intervals of a given number.

2. The flat panel display as claimed in claim 1, wherein the data-line driver includes shift registers that correspond to the first and second digital-to-analog converters, respectively, and operate in parallel.

3. The flat panel display as claimed in claim 2, wherein the pixel switch elements, first and second digital-to-analog converters, and shift registers contain thin-film transistors involving polysilicon active layers.

4. A flat panel display comprising:

a display panel having an array substrate including a matrix of data lines and scan lines arranged on an insulating substrate, pixel switch elements arranged at intersections of the data and scan lines, and pixel electrodes connected to the pixel switch elements, a counter electrode facing the pixel electrodes, and a light modulation layer interposed between the pixel electrode and the counter electrode;

a data-line driver for providing the data lines with corresponding analog video signals; and a scan-line driver for providing the scan lines with scan signals, the data-line driver including:

video bus lines arranged on the insulating substrate;

a switch circuit for electrically connecting video bus lines to corresponding ones of the data lines; and at least first, second, and third digital-to-analog converters for sequentially converting digital video signals to analog signals, each of the first, second, and third digital-to-analog converters connected to plural of data lines respectively, and giving analog video signals to correspond data lines in accordance with the analog signals, the data line electrically connected to the first digital-to-analog converter, the data line electrically connected to the second digital-to-analog converter, and the data line electrically connected to the third digital-to-analog converter being alternately arranged at intervals of a given number.

5. A flat panel display comprising:

a display panel having an array substrate including a matrix of data lines and scan lines arranged on an insulating substrate, pixel switch elements arranged at intersections of the data and scan lines, and pixel electrodes connected to the pixel switch elements, a counter electrode facing the pixel electrodes, and a light modulation layer interposed between the pixel electrode and the counter electrode;

a data-line driver for providing the data lines with corresponding analog video signals; and a scan-line driver for providing the scan lines with scan signals, the data-line driver including:

video bus lines arranged on the insulating substrate;

a switch circuit for electrically connecting video bus lines to corresponding ones of the data lines; and at least first, second, third, and fourth digital-to-analog converters for sequentially converting digital video signals to analog signals, each of the first, second, third, and fourth digital-to-analog converters connected to plural of data lines respectively, and giving analog video signals to correspond data lines in accordance with the analog signals, the data line electrically connected to the first digital-to-analog converter, the data line electrically connected to the second digital-to-analog converter, the data line electrically connected to the third digital-to-analog converter, and the data line electrically connected to the fourth digital-to-analog converter being alternately arranged at intervals of a given number.

6. The flat panel display of claim 5, wherein the first and second digital-to-analog converters provide positive analog video signals based on a reference voltage, and the third and fourth digital-to-analog converters provide negative analog video signals based on the reference voltage.

7. The flat panel display of claim 6, wherein the switch circuit switches relationships between the video bus lines and the corresponding data lines at predetermined intervals.

8. The flat panel display of claim 5, wherein the pixel switch elements and switch circuit contain thin-film transistors having polysilicon active layers.

9. The flat panel display of claim 5, wherein the first to fourth digital-to-analog converters are formed on an external driver circuit board.

10. A flat panel display comprising:

a display panel having an array substrate including a matrix of data lines and scan lines arranged on an insulating substrate, pixel switch elements arranged at intersections of the data and scan lines, and pixel electrodes connected to the pixel switch elements, a counter electrode facing the pixel electrodes, and a light modulation layer interposed between the pixel electrodes and the counter electrode;

a data-line driver for providing the data lines with corresponding analog video signals; and a scan-line driver for providing the scan lines with scan signals, the data-line driver including:

video bus lines arranged on the insulating substrate;

at least first and second digital-to-analog converters electrically connected to the video bus lines, for sequentially converting digital video signals into analog signals, each of the first and second digital-to-analog converters connected to plural of data lines respectively, and giving analog video signals to correspond data lines in accordance with the analog signals; and at least first and second shift registers for sequentially carrying out serial-to-parallel conversion on the analog video signals for the data lines and connecting them to data line groups that have been formed by dividing the data lines in a data line extending direction, the data lines electrically connected to the first digital-to-analog converter and the data lines electrically connected to the second digital-to-analog converter being alternately arranged at intervals of a given number, the data line connected to a first stage of the first shift register and the data line connected to a first stage of the second shift register, or the data sine connected to a last stage of the first shift register and the data line connected to a last stage of the second shift register being arranged adjacent to each other.

* * * * *